US006013983A

United States Patent [19]

Asano et al.

[11] Patent Number: 6,013,983

[45] Date of Patent: Jan. 11, 2000

[54] TRANSPARENT COLORED CONDUCTIVE FILM

[75] Inventors: Masaaki Asano; Kazuo Senda, both of Tokyo-To, Japan

[73] Assignee: Dai Nippon Printing Co., Ltd., Japan

[21] Appl. No.: 08/774,174

[22] Filed: Dec. 26, 1996

[30] Foreign Application Priority Data

Dec. 28, 1995 [JP] Japan ..... 7-352415

[51] Int. Cl.[7] ..... H01J 17/02; H01J 61/02

[52] U.S. Cl. ..... 313/581; 313/582; 313/587; 313/112

[58] Field of Search ..... 106/117, 441, 106/425; 252/519.51, 520.1; 313/112, 581, 582, 584, 585, 586, 587

[56] References Cited

U.S. PATENT DOCUMENTS

| | | | |
|---|---|---|---|
| 5,138,225 | 8/1992 | Kim | 313/582 X |
| 5,144,200 | 9/1992 | Kim | 313/584 X |
| 5,541,479 | 7/1996 | Nagakubo | 313/584 X |
| 5,742,122 | 4/1998 | Amemiya et al. | 313/582 X |

*Primary Examiner*—Ashok Patel
*Attorney, Agent, or Firm*—Parkhurst & Wendel, L.L.P

[57] ABSTRACT

A transparent colored conductive film is provided which can serve as both a color filter and a transparent electrode. Further, there are provided a composition for a transparent colored conductive film, comprising a metallic compound convertible to an oxide upon heating, a black or color inorganic pigment, and a liquid medium, a method for forming a transparent colored conductive film using the composition, and a display device having the transparent colored conductive film.

12 Claims, 4 Drawing Sheets

TRANSPARENT COLORED CONDUCTIVE FILM

TECHNICAL FIELD

The present invention relates to a transparent colored conductive film suitable as a transparent electrode for display devices, such as plasma display panels, liquid crystal display devices, and electroluminescence display devices, and a display device using the same.

BACKGROUND OF INVENTION

Electrode materials having high transparency (permeability) to visible light have been used as an electrode for display devices, such as plasma display panels, liquid crystal display devices, electroluminescence display devices and the like.

Conventional transparent conductive materials used for this purpose include, for example, tin oxide-base, zinc oxide-base, antimony oxide-base, and indium oxide/tin oxide-base (ITO) materials. These metallic oxides can easily form a film as a transparent conductive film on a glass or ceramic substrate. Conventional methods for the formation of such transparent conductive films include, for example, vacuum deposition, sputtering, CVD, and coating.

Among these conventional methods, vacuum deposition, sputtering, and CVD are unsatisfactory in respect of cost and mass productivity because film formation apparatuses used in these methods are complicated and expensive. The so-called "sol-gel process" has been proposed in order to solve these problems. Transparent conductive films formed by the coating method are not yet satisfactory in quality.

The so-called "photolithography" is known as a method for patterning the transparent conductive film formed on the substrate. Specifically, the conventional positive-working patterning method comprises the steps of: evenly coating a resist (a positive-working photosensitive resin) on the surface of a transparent conductive film formed on a substrate; drying the coating to form a photosensitive layer; exposing the photosensitive layer through a mask having a predetermined pattern; removing exposed areas with a developing solution; and conducting etching using the resist in unexposed areas as a mask. On the other hand, the conventional negative-working patterning method comprises the steps of: providing a negative-working photosensitive resin; conducting exposure in the same manner as described above; removing unexposed areas with a developing solution; and conducting etching using the resist in exposed areas as a mask to from a pattern.

In the above display device having a transparent conductive film, when the display of a color image is contemplated, color filters composed of color matrixes of the so-called "RGB" (red, green, and blue) should be disposed between a glass front substrate constituting a image display surface and the above transparent electrode. Further, if necessary, a light-shielding layer is formed in the boundary between each two of the RGB regions from the viewpoint of improving the contrast of the displayed image.

Light emitted from the display device through such color filters is separated into respective colors of RGB, and the separated RGB light are subjected to additive color process in a desired combination permitting color images of all color tones to be displayed.

The above methods for the formation of a patterned electrode have hitherto been carried out in the art. They, however, involve many steps suffering from problems, such as a problem of storage stability of the resist, a problem of the sensitivity of the resist, a problem of even coating of the resist, and problems of exposure and development. This unfavorably renders the production process complicated and, in addition, incurs increased cost. Printing of a coating liquid containing ingredients for forming a transparent conductive film in a pattern form followed by heating is considered as a method for solving these problems. In this method, however, it is difficult to form a fine pattern on the order of microns or submicrons, and, hence, the formed fine pattern is utterly unsatisfactory in accuracy.

Further, in the prior art, combining a transparent electrode with a color filter is indispensable for the application to a color display device, and, moreover, even a very small defect is unacceptable for the color filter, requiring a strict quality control in the production of the color filter, inevitably posing a problem of increased cost. That is, the problem involved in the color filter is added to the problems involved in the conventional transparent electrode.

DISCLOSURE OF INVENTION

Accordingly, an object of the present invention is to provide a composition, for a transparent colored conductive film, which can easily form a transparent colored conductive film capable of functioning both as a color filter and as a transparent electrode and, at the same time, form a fine pattern with a high accuracy.

Another object of the present invention is to provide a process for forming a transparent colored conductive film using the above composition.

A further object of the present invention is to provide a display device having this transparent colored conductive film.

In order to attain the above objects, according to the present invention, there is provided a composition for a transparent colored conductive film, comprising: a metallic compound convertible to an oxide upon heating; a black or color inorganic pigment; and a liquid medium.

According to another aspect of the present invention, there is provided a method for forming a transparent colored conductive film, comprising the steps of: coating the above composition in a pattern form on a heat-resistant substrate, or alternatively forming a film of the above composition on a heat-resistant substrate and exposing the film to an ionizing radiation in a desired pattern form followed by development to pattern the film; and heat-treating the patterned film to prepare a transparent colored conductive film.

According to a further aspect of the present invention, there is provided a display device adapted for emitting a plurality of different colored lights to display a color image on a display surface, wherein the above transparent colored conductive film is provided on a back surface opposite to the display surface.

The features of the present invention will be exemplified according to the following preferred embodiments.

For example, a composition comprising a metallic compound convertible to an oxide upon heating, a black or color inorganic pigment, and a heat decomposable resin is used to form a pattern of the composition on a substrate, and, upon heat treatment, the metallic compound is converted to a metallic oxide, while the heat decomposable resin present together with the metallic compound and the pigment in the film is removed by decomposition and vaporization, thereby forming a transparent colored conductive film.

Further, for example, a composition comprising a metallic compound convertible to an oxide upon heating, a black or color inorganic pigment, and a radiation decayable resin or a radiation curable resin is coated on a substrate to form a photosensitive layer, and in this state, pattern exposure and development are performed. Upon heating of the layer which has been developed in a pattern form, the metallic compound is converted to a metallic oxide, and the radiation decayable resin present together with the metallic compound and the pigment in the film is removed by decomposition and vaporization, thereby forming a transparent colored conductive film in any desired pattern.

Further, a composition comprising one compound or a mixture of two or more compounds, selected from an indium compound, a tin compound, a zinc compound, and an antimony compound having at least one functional group or site responsive to light, and a black or color inorganic pigment is coated on a substrate to form a photosensitive layer, and, upon pattern exposure in this state, the functional group or site of the compound responsive to light is rendered insoluble or soluble in a developing solution by a reaction of the metal atom. Soluble areas are removed by a developing solution to conduct development. The layer which has been subjected to pattern development is heat-treated to cause the metallic compound to be converted to a metallic oxide, while the functional group or site, responsive to light, present together with the metallic compound and the pigment in the film is removed by heat decomposition and evaporation, thereby forming a transparent colored conductive film in any desired pattern.

Thus, according to the present invention, neither a complicated nor an expensive device is required in the formation of a colored transparent electrode. Further, the transparent conductive film formed according to the present invention can be colored in any desired hue and any desired pattern and, hence, can function also as a color filter, eliminating the need to separately provide a color filter in the construction of a display device.

BEST MODE FOR CARRYING OUT THE INVENTION

Figure 1:
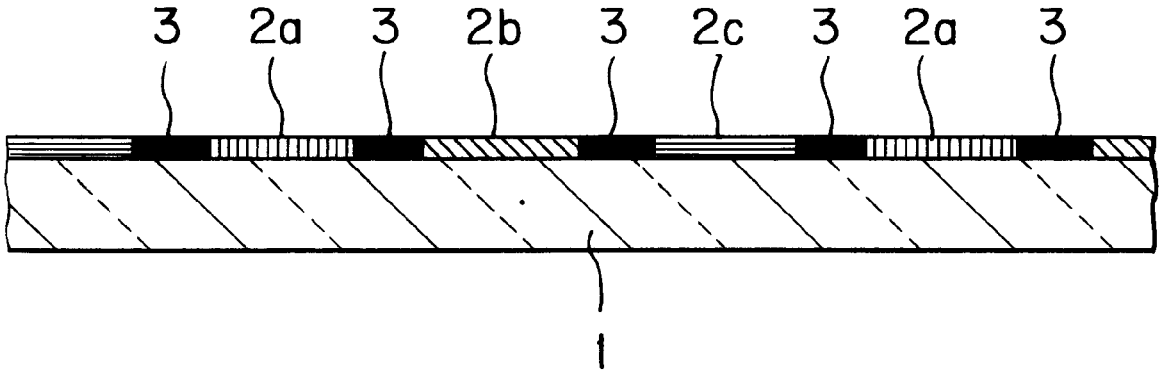
FIG. 1 is a cross-sectional view of a transparent colored conductive film according to the present invention.

The present invention will be described in more detail with reference to the following preferred embodiments.

The composition for a transparent colored conductive film according to the present invention comprises a metallic compound convertible to an oxide upon heating, a black or a color inorganic pigment, and a liquid medium.

Metallic compounds usable herein include indium, tin, zinc, and antimony compounds, or a mixture of two or more of these compounds. Examples of preferred indium compounds convertible to oxides upon heating include organic or inorganic salts of indium, such as indium formate, indium acetate, indium oxalate, indium nitrate, and indium chloride, and hydrates thereof; indium alkoxides, such as indium methoxide, indium ethoxide, indium propoxide, and indium butoxide, chelate compounds of the above compounds with α-diketones, α- or β-ketonic acids, esters of the above ketonic acids, α- or β-amino alcohol and the like; and indium hydroxide prepared by neutralizing or hydrolyzing the above compounds.

Examples of preferred tin compounds convertible to oxides upon heating include organic or inorganic salts of tin, such as tin formate, tin acetate, tin oxalate, tin nitrate, and tin chloride, and hydrates thereof; tin alkoxides, such as tin methoxide, tin ethoxide, tin propoxide, and tin butoxide, chelate compounds of the above compounds with α-diketones, α- or β-ketonic acids, esters of the above ketonic acids, α- or β-amino alcohol and the like; and tin hydroxide prepared by neutralizing or hydrolyzing the above compounds.

Examples of preferred zinc compounds convertible to oxides upon heating include organic or inorganic salts of zinc, such as zinc formate, zinc acetate, zinc oxalate, zinc nitrate, and zinc chloride, and hydrates thereof; zinc alkoxides, such as zinc methoxide, zinc ethoxide, zinc propoxide, and zinc butoxide, chelate compounds of the above compounds with α- or β-ketonic acids, esters of the above ketonic acids, α- or β-amino alcohol and the like; and zinc hydroxide prepared by neutralizing or hydrolyzing the above compounds.

Examples of preferred antimony compounds convertible to oxides upon heating include organic or inorganic salts of antimony, such as antimony formate, antimony acetate, antimony oxalate, antimony nitrate, and antimony chloride, and hydrates thereof; antimony alkoxides, such as antimony methoxide, antimony ethoxide, antimony propoxide, and antimony butoxide, chelate compounds of the above compounds with α- or β-ketonic acids, esters of the above ketonic acids, α- or β-amino alcohol and the like; and antimony hydroxide prepared by neutralizing or hydrolyzing the above compounds.

When a mixture of the above indium compound with the above tin compound is used, the ratio of the indium compound to the tin compound is preferably 1: (0.01 to 0.20) in terms of the atomic ratio of indium to tin. When the tin content is insufficient, the carrier density becomes low, unfavorably deteriorating the conductivity. On the other hand, when the amount of tin used is excessively large, the carrier mobility is lowered resulting in deteriorated conductivity or the like.

When a mixture of the above tin compound with the above antimony compound is used, the ratio of the tin compound to the antimony compound is preferably 1: (0.01 to 0.20) in terms of the atomic ratio of tin to antimony. When the antimony content is insufficient, the creation of electrons is unsatisfactory resulting in unfavorably deteriorated conductivity or the like. On the other hand, when the amount of antimony used is excessively large, a reduction in oxygen vacancies results in deteriorated conductivity or the like.

When the zinc compound is used as a component, it is preferably used alone.

Further, in the present invention, it is also possible to use as the metallic compound a compound having a functional group or site responsive to light. Examples of preferred metallic compounds include indium compounds having at least one functional group or site and/or tin compounds having at least one functional group or site and/or antimony compounds having at least one functional group or site and/or antimony compounds having at least one functional group or site.

Indium compounds, tin compounds, zinc compounds, and antimony compounds having a functional group(s) responsive to light or a site(s) responsive to light can be prepared by reacting organic or inorganic salts of indium, such as indium formate, indium acetate, indium oxalate, indium nitrate, and indium chloride; organic or inorganic salts of tin, such as tin formate, tin acetate, tin oxalate, tin nitrate, and tin chloride; indium alkoxides, such as indium methoxide, indium ethoxide, indium propoxide, and indium butoxide; tin alkoxides, such as tin methoxide, tin ethoxide, tin propoxide, and tin butoxide; organic or inorganic salts of zinc, such as zinc formate, zinc acetate, zinc oxalate, zinc nitrate, and zinc chloride; organic or inorganic salts of antimony, such as antimony formate, antimony acetate, antimony oxalate, antimony nitrate, and antimony chloride; zinc alkoxides, such as zinc methoxide, zinc ethoxide, zinc propoxide, and zinc butoxide; and antimony alkoxides, such as antimony methoxide, antimony ethoxide, antimony propoxide, and antimony butoxide, with an organic material capable of combining with these metals to form chelates.

In this case, organic compounds, which combine with these metals to form chelates and are eliminated upon exposure to light, include, for example, acetyl acetone, benzoyltrifluoroacetone, pivaloyltrifluoroacetone, methyl acetoacetate, ethyl acetoacetate, phenolacetoacetic acid, benzoic acid, naphthol, and naphthoic acid.

The reaction of the indium compound, tin compound, and zinc compound with the above chelate forming compound, for example, when an alkoxide is used as the indium compound with acetylacetone being used as the chelate forming compound, is carried out as follows.

$$In(OR)_n + xCH_3COCH_2COCH_3 \rightarrow In(OR)_{n-x}(OC(CH_3)=CH(OCH_3)_x + ROH$$

wherein R represents an alkyl group in an alkoxide group and n is the valency of indium.

In the indium compound and tin compound having a functional group or site, bonding of at least one bonding site of the metal atom to a photofunctional group suffices for the present invention, while other bonding sites may be in a salt form.

The ratio of the indium compound to the tin compound is preferably 1: (0.01 to 0.20) in terms of the atomic ratio of indium to tin. An insufficient amount of tin used unfavorably results in low carrier density, deteriorated conductivity or the like. On the other hand, when the amount of tin used is excessively large, the carrier mobility is so low that the conductivity is likely to lower.

When a mixture of the tin compound with the antimony compound is used, the ratio of the tin compound to the antimony compound is preferably 1: (0.01 to 0.20) in terms of the atomic ratio of tin to antimony. When the antimony content is insufficient, a reduction in creation of electrons leads to deteriorated conductivity. On the other hand, when the amount of antimony used is excessively large, a reduction in oxygen vacancies unfavorably results in deteriorated conductivity or the like. Further, when the zinc compound is used as a component, it is preferably used alone.

In the present invention, the above metallic compound, when it is in the form of an oxide, is permeable to light. In the present invention, the expression "transmittable to light" means that the metallic compound, when it is in the form of an oxide, has satisfactory light transmittance, required of a color filter for an image display, including "being transparent."

The composition of the present invention may, if necessary, further contain a binder resin. In particular, when the above metallic compound per se is not sensitive to light, if necessary, the use of a positive-working or negative-working binder resin is preferred. When the metallic compound per se is sensitive to light, the use of the binder resin is not indispensable. If necessary, however, a resin having an ordinary function as a binder and a positive-working or negative-working binder resin may be used.

For example, the so-called "positive-working photosensitive resin" may be used as the radiation (ionizing radiation) decayable resin, and examples thereof include positive-working resists, such as polymethyl vinyl ketone, polyvinyl phenyl ketone, polysulfone, diazonium salts, such as p-diazophenylamine-paraformaldehyde polycondensation product, quinonediazides, such as 1,2-naphthoquinone-2-diazido-5-sulfonic acid isobutyl ester, polymethyl methacrylate, polyphenylmethylsilane, and polymethyl isopropenyl ketone. On the other hand, the so-called "negative-working photosensitive resin" is usable as the radiation (ionizing radiation) polymerizable resin, and examples thereof include naturally occurring, water-soluble polymers, such as gelatin, casein, glue albumin, gum arabic, and starch, or synthetic, water-soluble polymers, such as polyvinyl alcohol and polyacrylamide, dichromic acid-base photosensitive resins comprising a polymer having an unshared electron pair, such as a hydroxyl, amino, carboxyl, or sulfonic group, and a salt of dichromic acid, photodimerizable, photosensitive resin having therein a cinnamoyl or cinnamilydene group, photopolymerizable prepolymers having an unsaturated double bond group, such as a vinyl, acryloyl, allyl, or internally unsaturated group, and photopolymerization photosensitive resins prepared by combining a photopolymerizable polyfunctional monomer, a photosensitive polymer, and an unpolymerizable polymer material.

Further, in the present invention, heat decomposable resin binders are also usable, and preferred examples thereof include cellulosic resins, such as ethyl cellulose, methyl cellulose, nitrocellulose, acetyl cellulose, acetylethyl cellulose, cellulose propionate, hydroxypropyl cellulose, butyl cellulose, benzyl cellulose, and nitrocellulose, or acrylic resins comprising polymers or copolymers, such as methyl methacrylate, ethyl methacrylate, n-butyl methacrylate, isobutyl methacrylate, isopropyl methacrylate, 2-ethylmethyl methacrylate, and 2-hydroxyethyl methacrylate.

The above photosensitive resin imparts photosensitivity to the composition of the present invention and, in addition, functions also as a binder for the resultant composition (coating liquid) and functions to impart coatability to the coating liquid. The amount of the photosensitive resin used is preferably 10 to 1,000 parts by weight based on 100 parts by weight in total of the indium compound, the tin compound, the zinc compound, and the antimony compound. When the amount of the photosensitive resin used is excessively small, the coating liquid is unfavorably likely to solidify. On the other hand, the use of an excessively large amount of the photosensitive resin results in deteriorated quality of the oxide film formed by firing after patterning, which is unfavorable from the viewpoint of electrical properties.

The composition of the present invention contains a black or color inorganic pigment as an indispensable ingredient. The color inorganic pigment is preferably any one of red, green, and blue pigments.

For example, any heat-resistant pigment may be used as a colorant suitable for a color filter for PDP. In this case, high heat resistance enough to withstand a temperature of about 450 to 600° C. suffices for the present invention although it depends upon the production process of a substrate. Further, it is also possible to use a colored glass which can ensure the selectivity for wavelength in a thin film thickness.

There are many heat-resistant pigments, and representative examples thereof include iron (red), manganese aluminate (pink), gold (pink), antimony-titanium-chromium (pink), iron-chromium-zinc (brown), iron (brown), titanium-chromium (yellowish brown), iron-chromium-zinc (yellowish brown), iron-antimony (yellowish brown), antimony-titanium-chromium (yellow), zinc-vanadium (yellow), zirconium-vanadium (yellow), chromium (green), vanadium-chromium (green), cobalt (blue), cobalt aluminate (blue), vanadium-zirconium (blue), and cobalt-chromium-iron (black). It is also possible to mix of two or more of them to adjust the color tone. Further, the proportion of particles having a diameter of not less than 1 $\mu$m is not more than 10% by weight based on the total weight of the particles. This is because when the proportion of particles having a large diameter is high, the transmittance is lowered resulting in deteriorated brightness. Further, when the proportion of particles having a diameter of 0.01 to 0.7 $\mu$m is preferably not less than 20% by weight based on the total weight of the particles.

There are numerous types of color glasses according to coloring mechanisms. Further, even when the same raw material is used, the color varies depending upon conditions. One example of the frit is composed mainly of a potash-lead glass containing silicic acid ($SiO_2$), lead oxide (PbO), potassium oxide ($K_2O_5$), boric acid ($B_2O_3$), aluminum fluoride ($AlF_3$), and arsenic oxide ($As_2O_3$). Raw materials usable herein include silica, minium, yellow lead oxide, white lead, potassium nitrate, boric acid, borax, sodium bicarbonate, and fluorides. The raw material is combined and mixed with a colorant, such as arsenious acid (white), tin oxide (white), copper oxide (green), cobalt oxide (blue), potassium bichromate (yellow), antimony oxide (yellow), iron oxide (brown), manganese dioxide (purple), nickel oxide (purple), gold chloride (red), sodium uranate, or selenium red (vermillion). The mixture is heat-melted and vitrified, and the vitrified product is cooled and ground to prepare a color glass which may be used in the present invention.

The composition according to the present invention may be prepared by dissolving or dispersing the above indispensable ingredients in a liquid medium. The composition of the present invention may further comprises a glass frit for improving the integrity of the pigment. Glass frits usable herein include, for example, "PLS3162S" manufactured by Nippon Electric Glass Co., Ltd. (pulverized transparent colorless glass).

Liquid media usable in the present invention include water, an organic solvent, or a mixture of water with the organic solvent. Examples of organic solvents usable herein include alcohols, such as methanol, ethanol, and isopropyl alcohol, acetic esters, such as ethyl acetate and butyl acetate, ketones, such as acetone, methyl ethyl ketone, diethyl ketone, and acetylacetone, ethers, such as methoxyethanol and ethoyethanol, ethers, such as dioxane and tetrahydrofuran, and aromatic compounds, such as toluene and xylene. The type and composition of the liquid medium used may be suitably selected according to the type of the indium compound, tin compound, zinc compound, inorganic pigment, and binder resin used.

For example, when the indium compound, tin compound, zinc compound, and antimony compound used are a salt thereof and the photosensitive resin is a water-soluble resin, preferably, water or a mixture of water with an organic solvent is used and, if necessary, the salt is previously neutralized to convert the metal salt to a hydroxide. On the other hand, when the indium compound, tin compound, zinc compound, and antimony compound are an organometallic compound, such as an alkoxide, and the photosensitive resin is a resin soluble in an organic solvent, preferably, an organic solvent or a mixture of an organic solvent with water may be used as the medium and, if necessary, the organometallic compound is previously hydrolyzed to convert the organometallic compound to a hydroxide. The above neutralization or hydrolysis brings the metallic component to a hydroxide or an oxide, resulting in the formation of a dispersion of fine particles (a sol or a colloid).

The amount of the liquid medium used may vary depending upon the indium compound, tin compound, zinc compound, antimony compound, black or color inorganic pigment, and photosensitive resin used. In general, however, it is preferably such that the solid content of the above indispensable ingredients is 1 to 30% by weight. When the amount of the liquid medium used is insufficient, the coatability of the coating liquid is likely to be lowered. On the other hand, when it is excessively large, the thickness of an oxide film formed by firing the coating is so small that a defect is likely to be created in the film.

A process for producing a transparent colored conductive film will be described in more detail. When the transparent colored conductive film is formed from a composition comprising a metallic compound convertible to an oxide upon heating, a black or color inorganic pigment, and a heat decomposable resin, the composition is applied in a pattern form on a substrate followed by heat treatment to convert the composition in a pattern form to an oxide with the heat decomposable resin present together with other ingredients in the film being decomposed and vaporized, thereby forming a transparent colored conductive film.

In this case, the composition can be easily prepared by satisfactorily kneading and milling the above ingredients to finely disperse the pigment. If necessary, neutralization or hydrolysis may be performed after the preparation of the composition. Further, if necessary, the composition may further comprise additives such as a sensitizer. The composition may be prepared in a high concentration and, immediately before use, diluted with a liquid medium to impart coatability to the composition. In storing the composition, it is preferably stored in a cold dark place. According to the above embodiment of the method for forming a colored conductive film, a composition for a transparent colored conductive film is coated in a pattern form on a heat-resistant substrate, such as a glass plate by a printing method, such as screen printing, and then heat-treated. The heat treatment permits the metallic compound convertible to an oxide upon heating to be converted to a metallic oxide, while the heat decomposable resin present together with other ingredients in the film is removed by decomposition and vaporization, thereby forming a transparent colored conductive film. The heat treatment is preferably conducted under conditions of about 400 to 550° C. and about 0.1 to 1.0 hr. Excessively mild heating conditions unfavorably result in unsatisfactory heat decomposition and crystallization. On the other hand, excessively severe heating conditions greatly affect the substrate and lead to excessive oxidation of ITO per se, making it impossible to satisfactorily ensure oxygen defects necessary for the development of conductivity.

Preferably, the heat-treated transparent conductive film is irradiated with light at a wavelength of not more than 400 nm, preferably 150 to 400 nm. When the light applied is in a visible light region where the wavelength ranges more than 400 to 700 nm, most of the light passes through the transparent conductive film. When the wavelength exceeds 700 nm, some of the light is absorbed. In this case, however, the energy of the light is so small that the conduction electron density in the transparent conductive film cannot be enhanced. Further, when the wavelength of the light applied is less than 150 nm which is in a vacuum ultraviolet region, no industrial applicability is found. Light sources, for light irradiation, usable herein, include those using very high-pressure, high-pressure, medium-pressure, or low-pressure metal vapor gas, noble gas, hydrogen, $Xe_2$, Kr—Cl, and Xe—Cl, for example, light sources, such as high-pressure mercury lamp and an excimer lamp, and lasers, such as an excimer laser, a dye laser, an Ar ion laser, an $F_2$ layer. More specific examples thereof include an Hg—Xe ultraviolet lamp (main wavelength peak=360 nm) a low-pressure Hg lamp (main wavelength peak=254 nm), a Kr—Cl excimer lamp (main wavelength peak=222 nm), excimer lasers, such as Xe—Cl (308 nm), Xe—F (351 nm), Xe—Br (282 nm), Kr—F (249 nm), and Kr—Cl (222 nm), secondary harmonics of Ar ion laser (257.2 nm), secondary harmonics crystal of dye laser ($\beta$-$BaB_2.BO_4$, 205 nm), and $F_2$ laser (157 nm).

The irradiation energy in this light irradiation is such that grain masses are mutually linked to enhance the density of conduction electrons in the film, thereby lowering the electric resistance. Suitable setting may be made depending upon the transparent conductive film material used, thickness of the transparent conductive film, light sources used, and the purpose of using the transparent conductive film.

Materials for the substrate usable herein are heat-resistance materials such as glass and ceramics, and the substrate is used for applications such as a substrate for a color filter serving also as an electrode for a plasma display and a substrate for a color filter serving also as an electrode for a liquid crystal display device.

When the transparent colored conductive film is prepared from a composition comprising a metallic compound, which is a precursor of ITO, convertible to an oxide upon heating, a black or color inorganic pigment, and a radiation decayable resin, the film formation method comprises the steps of: first coating the composition, for a transparent colored conductive film, on a heat-resistant substrate, such as a glass plate; drying the coating to form a film; exposing the film to a radiation in a pattern manner; removing exposed areas by development; and heat-treating the developed patterned film. Specifically, a compositions of three colors of RGB or compositions of four colors of RGB and Bk are provided, and, for each color, the above process is repeated to prepare a transparent colored conductive film which functions also as a color filter.

Materials for the substrate usable herein are heat-resistance materials such as glass and ceramics, and the substrate is used for applications such as a substrate for a color filter serving also as an electrode for a plasma display and a substrate for a color filter serving also as an electrode for a liquid crystal display device.

Any of conventional coating methods, such as screen printing, roll coating, dip coating, and spin coating, may be used for coating the above composition on the substrate. Although the coverage of the composition may vary depending upon the applications of the resultant electrode substrate, it is generally about 10 to 100 $\mu$m on a solid basis for each color. Conditions for drying after coating may be suitably selected. In general, however, drying at a temperature, which does not adversely affect the photosensitive resin, for example, 100 to 200° C., for about 0.1 to 1 hr is suitable.

The film thus formed is opaque and is substantially nonconductive. A photomask having a desired fine pattern is adhered to the film, followed by exposure. The radiation used in the exposure is usually light having a wavelength of about 200 to 500 nm, and, for example, a high-pressure mercury lamp or the like may be used as the light source. The exposure causes the photosensitive resin in its exposed areas to be decomposed, permitting the film in its exposed areas to be rendered soluble in a developing solution or to be rendered separatable by the developing solution. Therefore, coating of the developing solution over the whole surface or immersion of the exposed substrate in the developing solution and, if necessary, spray of the developing solution on the surface of the exposed substrate result in separation of the film in its exposed areas, thereby forming a positive image.

The positive image is then heat-treated. The heat treatment causes the photosensitive resin remaining in the film to be decomposed and vaporized, while the indium compound, together with the tin compound, forms a composite oxide (ITO), thus imparting colored transparency and conductivity to the patterned film. The heat treatment is preferably conducted under conditions of about 400 to 550° C. and about 0.1 to 1.0 hr. Excessively mild heating conditions unfavorably result in unsatisfactory heat decomposition and crystallization. On the other hand, excessively severe heating conditions greatly affect the substrate and leads to excessive oxidation of ITO per se, making it impossible to satisfactorily ensure oxygen defects necessary for the development of conductivity.

Preferably, the heat-treated transparent conductive film is irradiated with light at a wavelength of not more than 400 nm, preferably 150 to 400 nm. When the light applied is in a visible light region where the wavelength ranges more than 400 to 700 nm, most of the light passes through the transparent conductive film. When the wavelength exceeds 700 nm, some of the light is absorbed. In this case, however, the energy of the light is so small that the conduction electron density in the transparent conductive film cannot be enhanced. Further, when the wavelength of the light applied is less than 150 nm which is in a vacuum ultraviolet region, no industrial applicability is found. Light sources, for light irradiation, usable herein include those using very high-pressure, high-pressure, medium-pressure, or low-pressure metal vapor gas, noble gas, hydrogen, $Xe_2$, Kr—Cl, and Xe—Cl, for example, light sources, such as high-pressure mercury lamp and an excimer lamp, and lasers, such as an excimer laser, a dye laser, an Ar ion laser, an $F_2$ layer. More specific examples thereof include an Hg—Xe ultraviolet lamp (main wavelength peak=360 nm) a low-pressure Hg lamp (main wavelength peak=254 nm), a Kr—Cl excimer lamp (main wavelength peak=222 nm), excimer lasers, such as Xe—Cl (308 nm), Xe—F (351 nm), Xe—Br (282 nm), Kr—F (249 nm), and Kr—Cl (222 nm), secondary harmonics of Ar ion laser (257.2 nm), secondary harmonics crystal of dye laser ($\beta$-$BaB_2.BO_4$, 205 nm), and $F_2$ laser (157 nm).

The irradiation energy in this light irradiation is such that grain masses are mutually linked to enhance the density of conduction electrons in the film, thereby lowering the electric resistance. Suitable setting may be made depending upon the transparent conductive film material used, thickness of the transparent conductive film, light sources used, and the purpose of using the transparent conductive film.

A colored ITO film in a pattern form exactly conforming to the pattern of the photomask is formed on the substrate through the above steps. As with the ITO film formed by conventional vacuum deposition, sputtering, or CVD, this ITO film has excellent transparency and, at the same time, is colored and excellent in conductivity. Therefore, according to the present invention, a transparent colored patterned electrode which can function also as a color filter useful for various applications can be provided through a simple process without use of any expensive apparatus and a troublesome resist.

When a radiation curable resin is used instead of the radiation decayable resin, a transparent colored conductive film can be formed in the same manner as described above, except that, after the preparation of a composition in the same manner as described above, the composition is coated on a heat-resistant substrate to form a coating which is then exposed to a radiation in a pattern manner followed by removal of unexposed areas by development.

When the composition comprises indium and tin compounds having a functional group responsive to light and a black or color inorganic pigment, the composition is prepared by dissolving or dispersing the above indispensable ingredients in a liquid medium. Liquid media usable in the present invention include water, an organic solvent, or a mixture of water with the organic solvent. Examples of organic solvents usable herein include alcohols, such as methanol, ethanol, and isopropyl alcohol, acetic esters, such as ethyl acetate and butyl acetate, ketones, such as acetone, methyl ethyl ketone, diethyl ketone, and acetylacetone, ethers, such as methoxyethanol and ethoyethanol, ethers, such as dioxane and tetrahydrofuran, and aromatic compounds, such as toluene and xylene.

The type and composition of the liquid medium used may be suitably selected according to the type of the indium compound, tin compound, and black or color inorganic pigment used. For example, when the indium and tin compounds having a functional group or site responsive to light used are soluble in water or hydrophilic such as in the case where they are partially in the form of a salt, water or a mixture of water with an organic solvent is used and, if necessary, the portion of the salt may be previously neutralized to convert the sale to a hydroxyl group.

On the other hand, when the indium and tin compounds having a functional group or site responsive to light used is significantly organic and, hence, soluble in an organic solvent, preferably, an organic solvent or a mixture of an organic solvent with water is used.

The amount of the liquid medium may vary depending upon the metallic compound used and the type of the black or color inorganic pigment. In general, however, it is preferably such that the solid content of the above indispensable ingredients in the coating liquid is 0.5 to 20% by weight. When the amount of the liquid medium used is insufficient, the coatability of the coating liquid is likely to be lowered and, at the same time, brushing or cracking is created in the resultant coating. on the other hand, when it is excessively large, the thickness of a transparent conductive film formed by firing the coating is so small that a defect is likely to be created in the film. Further, in this case, it is difficult to provide desired conductivity.

Further, in the present invention, preferably, a heat decomposable resin binder incorporated into the composition from the viewpoint of rendering the composition coatable. Examples of such resin binders usable herein include cellulosic resins, such as methyl cellulose, ethyl cellulose, acetyl cellulose, acetylethyl cellulose, hydroxypropyl cellulose, butyl cellulose, benzyl cellulose, nitrocellulose, cellulose acetate, cellulose propionate, and cellulose butylate, or acrylic resins comprising polymers or copolymers, such-as methyl methacrylate, ethyl methacrylate, n-butyl methacrylate, isobutyl methacrylate, isopropyl methacrylate, 2-ethylmethyl methacrylate, and 2-hydroxyethyl methacrylate.

The amount of the resin binder used is preferably 10 to 1,000 parts by weight based on 100 parts by weight in total of the metallic compound and the black or color inorganic pigment.

When the amount of the resin binder is excessively small, the coatability is unsatisfactory. On the other hand, the use of an excessively large amount of the binder resin results in deteriorated quality of the transparent conductive film formed by firing after patterning, which is unfavorable from the viewpoint of electrical properties.

As with the above composition, this composition can be easily prepared. If necessary, it may further contain additives such as sensitizers. The composition may be prepared in a high concentration and, immediately before use, diluted with a liquid medium to render the composition coatable. In storing the composition, it is preferably stored in a cold dark place.

For this method for forming a transparent colored conductive film, the material for the substrate, the coating method of the composition, coverage, applications and the like are the same as those described above in connection with the transparent colored conductive film. Upon exposure, the indium and tin compounds having a functional group or site in its exposed areas are photodecomposed, eliminating the photofunctional group, while the remaining film is insoluble in a developing solution. Therefore, coating of the developing solution over the whole surface of the exposed film or immersion of the exposed film in the developing solution and, if necessary, spray of the developing solution on the surface of the exposed film result in separation of the film in its unexposed areas, thereby forming a negative image.

The negative image is then heat-treated. The heat treatment causes the photofunctional group and binder resin (if any) remaining in the film to be decomposed and vaporized, while the indium compound, together with the tin compound, forms a composite oxide (ITO), thus imparting colored transparency and conductivity to the patterned film. In the heat treatment, preferred conditions are the same as those in the above first formation method. The film may, if necessary, be further irradiated with light having a wavelength of not more than 400 nm as described in the formation of the above transparent colored conductive film, resulting in lowered electrical resistivity.

A colored ITO film in a pattern form exactly conforming to the pattern of the photomask in the positive-negative relationship is formed on the substrate through the above steps. This ITO film is the same as that formed in the first formation method.

An embodiment of the above method will be described with reference to FIG. 1. In the embodiment shown in FIG. 1, a color filter serving also as an electrode is formed which comprises a light-shielding layer and three colors of RGB. At the outset, onto a glass plate 1 as a front surface of a display device is coated the above composition for red, and the resultant coating is dried, exposed through a mask, and developed to form a display anode (R) 2*a*. The composition for green is then coated, and the resultant coating is then dried, exposed through a mask, and developed to form a display anode (G) 2*b*. The composition for blue is then coated, and the resultant coating is dried, exposed through a mask, and developed to form a display anode (B) 2*c*. If necessary, a light-shielding layer 3 is formed between the display anodes. When the electrode is formed on the whole area as in an active matrix liquid crystal display device, the light-shielding layer also may be formed of the same conductive composition as used in black. On the other hand, the electrode should be provided in a stripe form as in segment type and STN type liquid crystal display devices and plasma display panels, R, G and B are arranged in a stripe form without providing the light-shielding layer, or alternatively an insulating light-shielding material may be formed so as to divide the stripe.

The insulating light-shielding layer may be formed by: (i) patterning a material of a dispersion of a black pigment in a photosensitive resin by photolithography; (ii) conducting patterning by printing using a glass paste with a black pigment dispersed therein, (iii) using chromium oxide, or (iv) using an insulating sol-gel material.

Finally, the whole area is heat-treated as described above to covert the RGB films to transparent colored conductive films, and each region of RGB functions as a color filter serving also as a display anode.

One embodiment of the display device according to the present invention will be described by taking a plasma display panel (PDP) as an example.

In general, PDP comprises two opposed glass substrates, a pair of electrodes systematically arranged in the glass substrates, and a gas (mainly Ne or the like) sealed therebetween. A voltage is applied across the electrodes to produce discharge within minute cells around the electrodes to emit light from each cell, thereby displaying information. Systematically arranged cells are selectively subjected to discharge luminescence in order to display information. Such PDPs are classified into two types, a direct current type PDP, wherein electrodes are exposed to a discharge space (DC type), and an alternating current type (AC type) wherein electrodes are covered with an insulating layer. Each of these types is further classified into a refresh drive system and a memory drive system according to display functions and memory drive systems.

Figure 2:
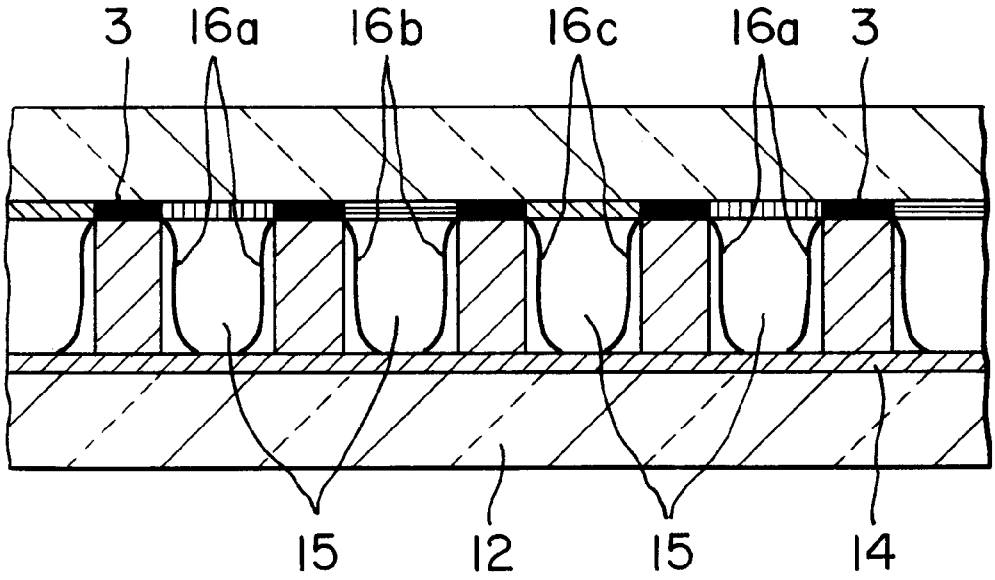
FIG. 2 is a cross-sectional view of one embodiment of a direct current (DC) type plasma display (PDP) device.

FIG. 2 is an embodiment of a DC type PDP. In this PDP, a front glass plate and a back glass plate are held by means of barrier ribs while leaving a given distance between the front glass plate and the back glass plate. RGB emitting phosphors are coated on the wall surface of the barrier ribs, and a display anode 13 and a cathode 14 are provided orthogonally to each other respectively on the front glass plate 11 and the back glass plate 12. Gas discharge is produced in a cell space 15 between the display anode 13 and the cathode 14. Ultraviolet light produced by the gas discharge excites the phosphors to respectively emit RGB light. Phosphors for emitting respective colored lights, red (R), green (G), and blue (B), are coated for respective different discharge cells (for example, a red light emitting phosphor 16*a*, a green light emitting phosphor 16*b*, and a blue light emitting phosphor 16*c*). According to the display device of the present invention, color filters R, G, and B which are selectively permeable to respective luminescent colors, i.e., red, green, and blue, are provided so as to function also as display anodes respectively in discharge cells R, G, and B, having the same construction as those in the conventional device, as shown in the drawing.

Further, an insulating black barrier material is provided on the barrier in each region between adjacent discharge cells to eliminate the reflection on regions other than luminescent regions on the display surface and to enhance the contrast of a displayed image. Application of a voltage across the anode and the cathode permits phosphors on the wall surface of respective cells to respectively emit RGB lights. Upon passage of the emitted RGB lights through transparent display anodes respectively for RGB, the light in its unnecessary wavelength components are removed, permitting pure RGB lights to be displayed through the front glass plate. In particular, when Ne is used as the filler gas, Ne discharge emits light with a wavelength of 580 nm, necessitating cut-off of this light.

Further, the phosphor per se is white and, hence, with the power of the display device being turned off, is perceived as white, increasing the reflection of external light. This also requires the provision of an insulating black barrier material in order to enhance the contrast.

Figure 3:
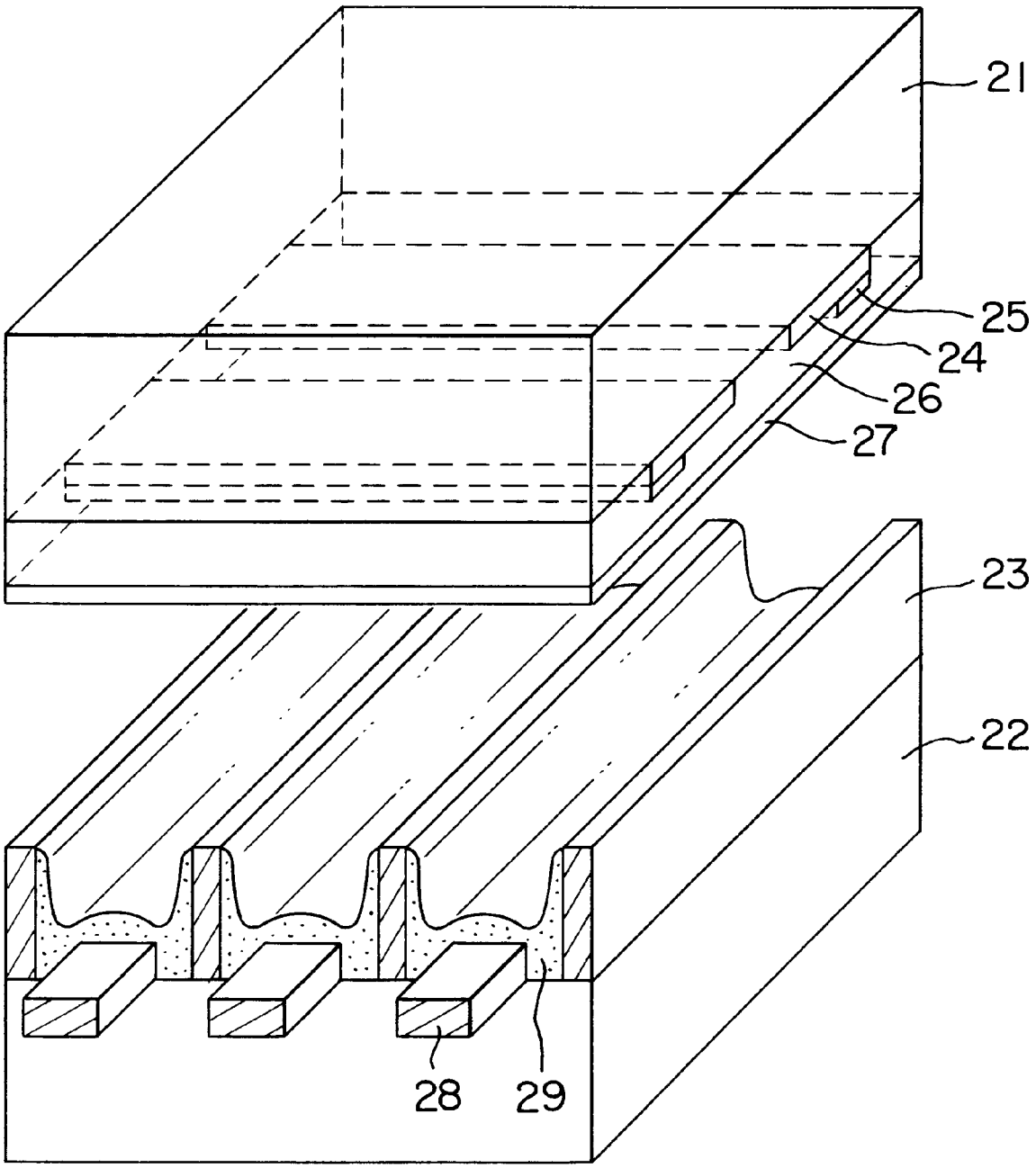
FIG. 3 is a cross-sectional view of one embodiment of an alternating current (AC) type PDP device.

FIG. 3 is an embodiment of the construction of an AC type PDP. In the drawing, the front plate 21 and the back plate 22 are shown separately from each other. As shown in the drawing, the front plate 21 and the back plate 22 each made of glass are disposed parallel and opposite to each other. Barrier ribs 23 stand on and are fixed to the back plate 22 in its the front plate side. These barrier ribs 23 hold the front plate 21 and the back plate 22 while leaving a given distance between these plates. Composite electrodes each comprising a sustaining electrode 24 as a transparent electrode and a bus electrode 25 as a metallic electrode are provided parallel to each other on the front plate 21 in its back side, and a dielectric layer 26 is provided so as to cover the composite electrode. Further, a protective layer 27 (MgO layer) is provided on the surface of the dielectric layer 26.

On the other hand, address electrodes 28 are provided, parallel to each other, between the barrier ribs 23 on the back plate 22 in its front plate side so as to be orthogonal to the composite electrodes. Further, a phosphor 29 is provided so as to cover the wall surface of the barrier ribs 23 and the bottom face of cells.

In this AC type PDP, a predetermined voltage from an alternating current source is applied across the composite electrodes on the front plate 1 to form an electric field, thereby conducting discharge in each cell as a display element defined by the front plate 21, the back plate 22, and the barrier ribs 23. The ultraviolet light produced by this discharge causes luminescence of the phosphor 29, and light being passed through 21 is viewed by an observer.

Figure 4:
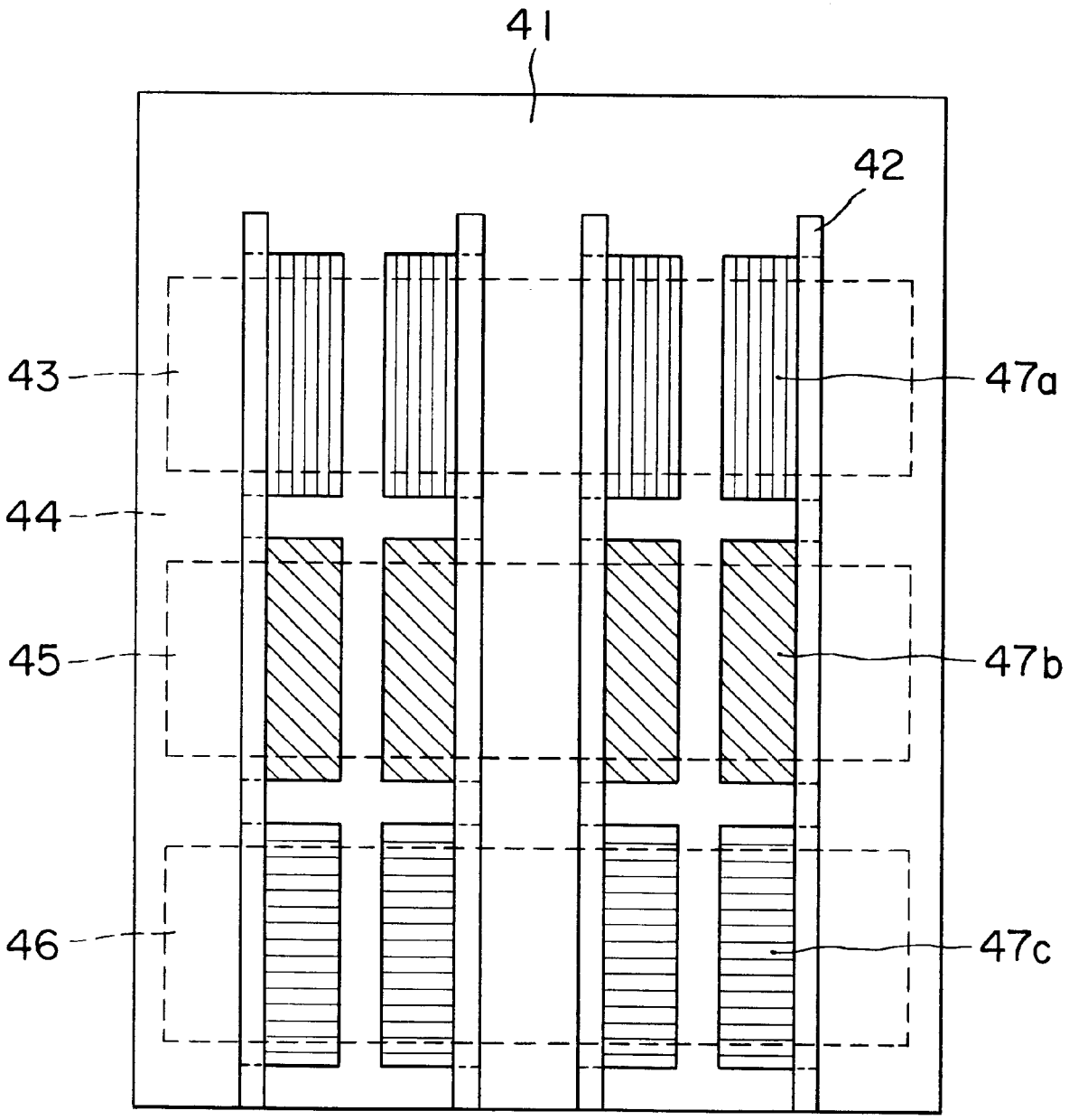
FIG. 4 is a diagram showing a specific construction where the present invention has been applied to an AC type PDP.

FIG. 4 is a diagram showing a front plate 41 as viewed from the back plate side. Composite electrodes comprising sustaining electrodes 47*a*, 47*b*, and 47*c* as red, green, and blue transparent electrodes and a bus electrode 42 as a metallic electrode are provided on the front plate 41 in its back plate side. Like FIG. 3, a dielectric layer is provided so as to cover the composite electrodes, and a protective layer is provided on the surface of the dielectric layer. Barrier forming sections (ribs) 44, which were provided at intervals on the back plate, are held so as to locate between sustaining electrodes of different colors. Fluorescent surface forming sections 43, 45, 46 are disposed on respective corresponding color sustaining electrodes. In order to conform the color to the color of the fluorescent surface between the barrier ribs, as shown in the drawing, the colored transparent electrode is cut in the direction of the barrier rib, and energization is performed by the bus electrode having high conductivity.

The present invention will be described in more detail with reference to the following examples. In the following description, all "parts" or "%" are by weight unless otherwise specified.

EXAMPLE 1

10.27 parts of indium nitrate, 0.33 part of stannous oxalate, 5 parts of a positive-working photosensitive resin (chemical name: polymethyl isopropenyl ketone), and 1.1 parts of each color inorganic pigment specified in Table 1 were added to 30 parts of acetyl acetone and 54.4 parts of methyl isobutyl ketone, and they were stirred at room temperature to dissolve them in one another to prepare solutions which were then filtered to remove insolubles, thereby preparing compositions (solid content: 10%), for three colors of R, G and B, according to the present invention.

EXAMPLES 2 TO 5

Compositions of the present invention were prepared in the same manner as in Example 1, except that ingredients specified in the following Table 1 were used instead of the ingredients in Example 1.

TABLE 1

| Ex. No. | Indium compound (parts) | Tin compound (parts) | Photosensitive resin (parts) | Color inorganic pigment (parts) | Solvent (parts/parts) |
|---|---|---|---|---|---|
| 2 | Indium acetate (10.00) | Tin acetate (0.38) | Polymethyl vinyl ketone (5) | Red pigment (1.0) | Acetylacetone/ THF (30/53.62) |
| 3 | Indium chloride (7.52) | Tin chloride (0.42) | Polyvinyl phenyl ketone (5) | Green pigment (0.8) | Acetylacetone (30/56.26) |
| 4 | Indium propoxide (8.36) | Tin propoxide (0.45) | Polyphenyl-methylsilane (5) | Blue pigment (0.9) | Acetylacetone/ THF (30/55.29) |
| 5 | Indium acetylacetonate (14.11) | Tin acetylacetonate (0.82) | Polysulfone (5)* | Black pigment (1.5) | Acetylacetone/ THF (30/48.57) |

*Polysulfone:

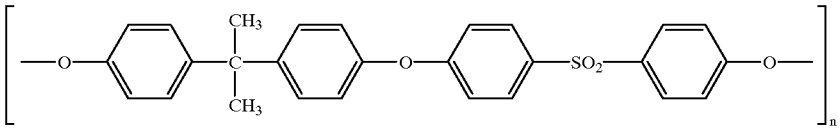

Red pigment: transparent iron oxide TOR (a finely-ground product of $\alpha Fe_2O_3$ acicular power), manufactured by Dainichiseika Color & Chemicals Manufacturing Co., Ltd.
Green pigment: TM Green #3330 (a finely-ground product of a mixed oxide of Co—Al—Cr—Ti), manufactured by Dainichiseika Color & Chemicals Manufacturing Co., Ltd.
Blue pigment: TM Blue #3450 (a finely-ground product of a mixed oxide of Co—Al), manufactured by Dainichiseika Color & Chemicals Manufacturing Co., Ltd.
Black pigment: Daipyroxide Black #9565, manufactured by Dainichiseika Color & Chemicals Manufacturing Co., Ltd.

EXAMPLE 6

The coating liquid prepared in Example 1 was homogeneously spin-coated on a glass substrate, and the coating was dried at 150° C. for 10 min. Then, the coated substrate was irradiated with ultraviolet light (wavelength 340 nm) through a photomask and immersed in the same solvent used in Example 1 to perform development. After the development, the substrate with a patterned coating is fired in air at 500° C. for 60 min. Thus, a glass substrate bearing a fine pattern of ITO could be prepared.

EXAMPLES 7 TO 10

A patterned electrode was prepared in the same manner as in Example 6, except that the coating liquids listed in the following Table 2 were used instead of the coating liquid in Example 6.

Evaluation

Figure 5:
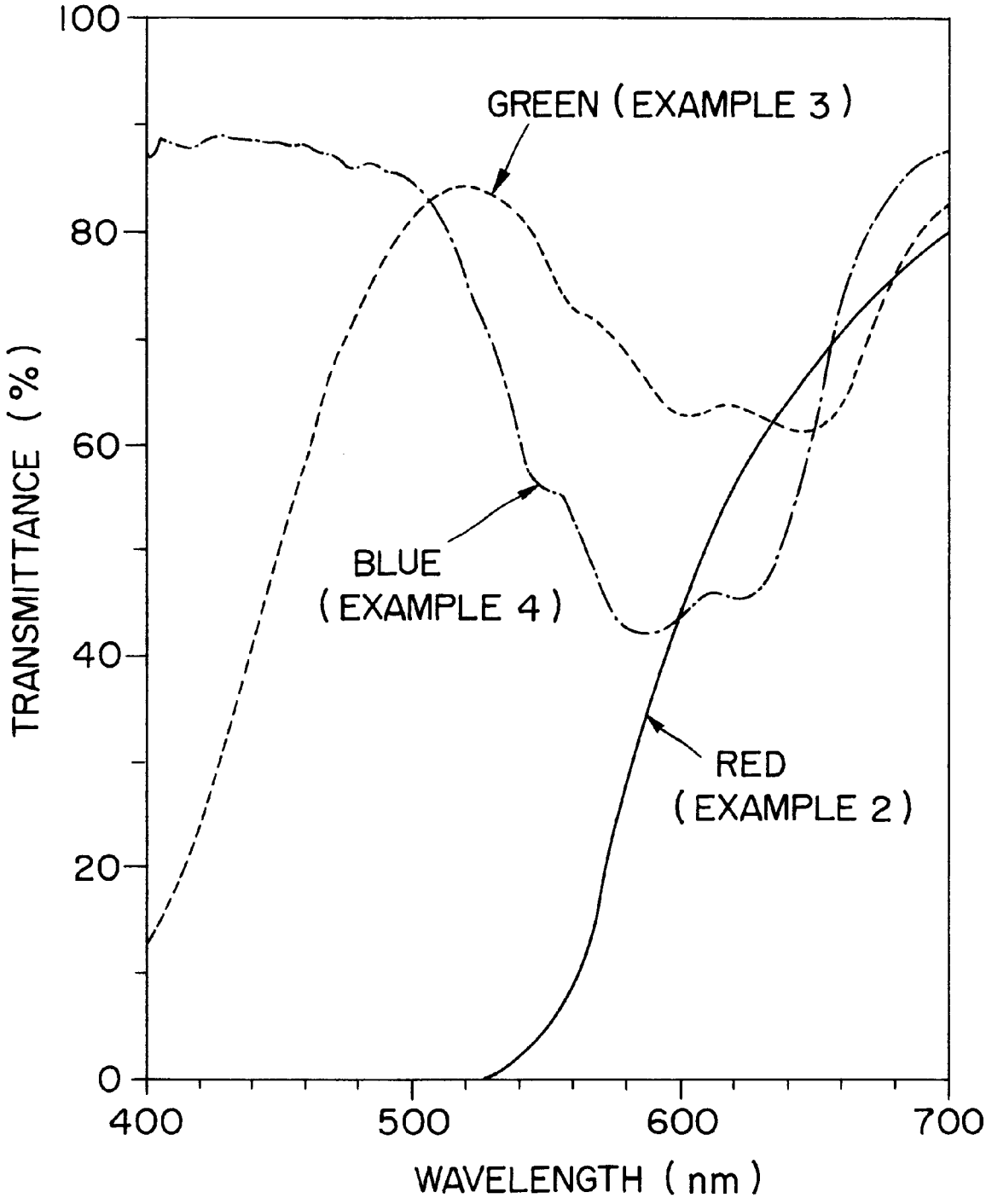
FIG. 5 is a graph showing colored transparency in Examples 2 to 4.

The film thickness, sheet resistance, adhesion, and resolution of the above patterned electrodes were as summarized in the following Table 2. The color transparency was determined for Examples 7 to 9 (coating liquids of Examples 2 to 4) alone. The results were as shown in FIG. 5. The color transparency was expressed in terms of measurements of transmittance (unit: T%) measured with a spectrophotometer.

TABLE 2

| Ex. No. | Coating liquid | Film thickness (μm) | Sheet resistance (Ω/○) | Adhesion | Resolution |
|---|---|---|---|---|---|
| 6 | Ex. 1 | 0.5 | 1,200 | ○ | ○ |
| 7 | Ex. 2 | 0.5 | 960 | ○ | ○ |

TABLE 2-continued

| Ex. No. | Coating liquid | Film thickness (μm) | Sheet resistance (Ω/○) | Adhesion | Resolution |
|---|---|---|---|---|---|
| 8 | Ex. 3 | 0.5 | 820 | ○ | ○ |
| 9 | Ex. 4 | 0.5 | 1,260 | ○ | ○ |
| 10 | Ex. 5 | 0.5 | 1,320 | ○ | ○ |

Film thickness: measured by ellipsometry.

Sheet resistance: measured by four probe method.

Adhesion and evaluation criteria: evaluated as "O" (good)" when no peeling occurred in a peeling test using a cellophane tape.

Resolution and evaluation criteria: evaluated as "O (good)" when a pattern of lines and spaces of 10 μm could be successfully formed by using a resolution chart of a photomask to perform exposure and etching for development by photolithography.

EXAMPLE 11

10.27 parts of indium nitrate, 0.33 part of stannous oxalate, 15 parts of an organic chelating agent (chemical name: acetylacetone), 10 parts of a resin binder (chemical name: ethyl cellulose, trade name: Ethocel STD-100, available from Dow Chem. Co.), and 2.5 parts of each color inorganic pigment specified in Table 3 were added to ethyl cellosolve, and they were stirred at room temperature to dissolve them in one another to prepare solutions which were then filtered to remove insolubles, thereby preparing compositions (solid content: 15%), for three colors of R, G and B, according to the present invention.

EXAMPLES 12 TO 15

Compositions of the present invention were prepared in the same manner as in Example 11, except that ingredients specified in the following Table 3 were used instead of the ingredients in Example 11.

TABLE 3

| Ex. No. | Indium compound (parts) | Tin compound (parts) | Chelating agent (parts) | Color inorganic pigment (parts) | Resin binder (parts) | Solvent (parts) |
|---|---|---|---|---|---|---|
| 12 | Indium acetate (10.00) | Tin acetate (0.38) | Acetylacetone (15) | Red pigment (2.5) | Ethocel STD-100 (10) | Ethyl cellosolve (62.12) |
| 13 | Indium chloride (7.50) | Tin chloride (0.42) | Benzoyltri-fluoroacetone (15) | Green pigment (2.3) | Ethocel STD-100 (10) | Ethyl cellosolve (64.78) |
| 14 | Indium isopropoxide (8.36) | Tin isopropoxide (0.45) | Phenolaceto-acetic acid (15) | Blue pigment (2.4) | Ethocel STD-100 (10) | Ethyl cellosolve (63.79) |
| 15 | Indium butoxide (11.3) | Tin butoxide (0.66) | Methyl acetoacetate (15) | Black pigment (2.7) | Ethocel STD-100 (10) | Ethyl cellosolve (60.34) |

Red pigment: transparent iron oxide TOR (a finely-ground product of $\alpha Fe_2O_3$ acicular power), manufactured by Dainichiseika Color & Chemicals Manufacturing Co., Ltd.
Green pigment: TM Green #3330 (a finely-ground product of a mixed oxide of Co—Al—Cr—Ti), manufactured by Dainichiseika Color & Chemicals Manufacturing Co., Ltd.
Blue pigment: TM Blue #3450 (a finely-ground product of a mixed oxide of Co—Al), manufactured by Dainichiseika Color & Chemicals Manufacturing Co., Ltd.
Black pigment: Daipyroxide Black #9565

EXAMPLE 16

The coating liquid prepared in Example 11 was homogeneously roll-coated on a glass substrate, and the coating was dried at 150° C. for 10 min. Then, the coated substrate was irradiated with ultraviolet light (wavelength 300 nm) through a photomask and immersed in a liquid etchant acidified with hydrochloric acid to perform development. After the development, the substrate with a patterned coating is fired in air at 500° C. for 60 min. Thus, a glass substrate bearing a fine pattern of ITO with an optical filter could be prepared.

EXAMPLES 17 TO 20

A patterned electrode was prepared in the same manner as in Example 16, except that the coating liquids listed in the following Table 4 were used instead of the coating liquid in Example 16. The film thickness, sheet resistance, adhesion, and resolution of the above patterned electrodes were as summarized in the following Table 4.

TABLE 4

| Ex. No. | Coating liquid | Film thickness (μm) | Sheet resistance (Ω/○) | Adhesion | Resolution |
|---|---|---|---|---|---|
| 16 | Ex. 1 | 0.5 | 1,250 | ○ | ○ |
| 17 | Ex. 2 | 0.5 | 1,250 | ○ | ○ |
| 18 | Ex. 3 | 0.5 | 1,230 | ○ | ○ |
| 19 | Ex. 4 | 0.5 | 1,240 | ○ | ○ |
| 20 | Ex. 5 | 0.5 | 1,270 | ○ | ○ |

Film thickness: measured by ellipsometry.

Sheet resistance: measured by four probe method.

Adhesion and evaluation criteria: evaluated as "O" (good)" when no peeling occurred in a peeling test using a cellophane tape.

Resolution and evaluation criteria: evaluated as "O (good)" when a pattern of lines and spaces of 10 μm could be successfully formed by using a resolution chart of a photomask to perform exposure and etching for development by photolithography.

As is apparent from the foregoing description, a transparent colored ITO film having a pattern exactly conforming to the pattern of a photomask is formed on a substrate, and this ITO film, as with the ITO film formed by the conventional CVD, is excellent in transparency, as well as in conductivity. Therefore, according to the present invention, a patterned transparent colored electrode useful for various applications can be provided by a simple process without using any expensive apparatus and any troublesome resist.

Further, the use of the composition and the method according to the present invention enables a display device, such as a plasma display panel, which emits a plurality of different colored lights to display an image on a display surface, to be easily provided at low cost.

EXAMPLES 21 TO 25

The patterned electrodes prepared in Examples 6 to 10 were irradiated once with Xe—Cl excimer laser (wavelength 308 nm) at an irradiation energy density of 200 mj/cm$^2$ under atmospheric environment.

Evaluation

The film thickness, sheet resistance, and adhesion of the above patterned electrodes were as summarized in the following Table 5.

TABLE 5

| Ex. No. | Film thickness (μm) | Sheet resistance (Ω/□) | Adhesion |
|---|---|---|---|
| 21 | 0.5 | 400 | ○ |
| 22 | 0.5 | 350 | ○ |
| 23 | 0.5 | 410 | ○ |
| 24 | 0.5 | 380 | ○ |
| 25 | 0.5 | 470 | ○ |

Irradiation with light at a wavelength of not less than 400 nm (irradiation with He—Ne laser (wavelength 633 nm)) resulted in only a slight lowering in electric resistance.

Application Example

An AC type PDP was prepared as follows.

A photosensitive Ag paste was coated on a glass substrate, and the coated substrate was exposed, developed, and fired to form an address electrode. A layer for a barrier was formed thereon by die coating, and a barrier pattern was formed by sandblasting through a mask having sandblasting resistance so as to sandwich the address electrode, followed by firing. Thereafter, a phosphor paste was coated, and the coating was then fired to prepare a back substrate. On the other hand, a front substrate was prepared as follows. A patterned transparent colored electrode (film thickness: 0.6 μm) was formed on a glass substrate, a photosensitive Ag paste was coated thereof, followed by exposure, development, and firing to form a bus electrode (5 μm). An insulating layer (a dielectric layer: thickness 0.8 μm) was formed by vacuum deposition, and a protective layer (thickness 0.3 μm) of magnesium oxide was further formed by vacuum deposition to prepare a front substrate.

The two substrates prepared above, front and back substrates, were laminated to each other so that the treated surfaces faced each other, and Ne—Ar (1.1%) Penning gas (500 Torr) was then filled to prepare an AC type PDP. The PDP was driven by means of a drive pulse with a driving waveform of drive frequency 15 kHz and duty ratio 23%. As a result, the panel was comparable favorably with a conventional panel wherein the color filter and the transparent electrode had respective different functions.

We claim:

1. A display device adapted for emitting a plurality of different colored lights to display a color image on a display surface, wherein a transparent colored conductive film formed from a composition comprising a metallic compound convertible to an oxide upon heating, a black or color inorganic pigment, and a liquid medium, the film having a hue corresponding to the colored light to be emitted, is provided on a back surface opposite to the display surface.

2. The display device according to claim 1, wherein a light-shielding layer is provided in the boundary between the transparent colored conductive films of different hues.

3. The display device according to claim 1, which is a plasma display panel.

4. The display device according to claim 1, wherein the metallic compound is selected from indium, tin, and zinc compounds and a mixture of at least two of said compounds.

5. The display device according to claim 1, wherein the composition further comprises a binder resin.

6. The display device according to claim 5, wherein the binder resin comprises a radiation decayable resin.

7. The display device according to claim 5, wherein the binder resin comprises a radiation polymerizable resin.

8. The display device according to claim 1, wherein the metallic compound has a functional group or site responsive to light.

9. The display device according to claim 1, wherein the metallic compound, when it is in the form of an oxide, is transmittable to light.

10. The display device according to claim 1, wherein the color inorganic pigment is any one of red, green and blue pigments.

11. The display device according to claim 8, wherein the metallic compound is selected from indium, tin, zinc, and antimony compounds having at least one functional group or site responsive to light and a mixture of at least two of said compounds.

12. The display device according to claim 5, wherein the binder resin comprises a heat decomposable resin.

* * * * *